US005364163A

United States Patent [19]

Hardison

[11] Patent Number: 5,364,163

[45] Date of Patent: Nov. 15, 1994

[54] ADJUSTABLE LEG FISHING CHAIR

[76] Inventor: Michael D. Hardison, 1031 N. Indiana Ave., Griffith, Ind. 46319

[21] Appl. No.: 89,474

[22] Filed: Jul. 12, 1993

[51] Int. Cl.[5] ..... A47C 1/02

[52] U.S. Cl. ..... 297/344.21; 297/4; 297/344.26

[58] Field of Search ..... 297/340, 344.1, 344.12, 297/344.13, 344.18, 344.21, 344.26

[56] References Cited

U.S. PATENT DOCUMENTS

| | | | |
|---|---|---|---|
| 2,711,787 | 6/1955 | Hallowell | 297/344.12 X |
| 4,169,625 | 10/1979 | Petersen | 297/344.26 |
| 4,226,398 | 10/1980 | Freber | 297/344.21 X |
| 4,266,748 | 5/1981 | Dalton | 297/4 X |
| 4,948,197 | 8/1990 | Sansing | 297/344.18 X |
| 5,110,184 | 5/1992 | Stein et al. | 297/344.26 |

*Primary Examiner*—Laurie K. Cranmer

[57] ABSTRACT

A new and improved adjustable leg chair includes a seat assembly and a leg assembly supporting the seat assembly. The leg assembly includes a seat support member supporting the seat assembly and leg members supporting the seat support member. The leg assembly also includes spike members connected to the leg members. The spike members project from the leg members in a direction opposite of the seat support member. The spike members are capable of penetrating into a sloped ground surface. The leg members may include two vertical portions connected to the seat support member and a transverse member connected between the two vertical portions. The vertical portions and the transverse member are in the form of a unified, integrated U-shaped leg member. The spike members are supported by and project from the transverse members. A swivel assembly is located between the seat assembly and the leg assembly. The swivel assembly supports the seat assembly and the swivel assembly is supported by the leg assembly. Two of the leg members include a telescopic length adjusting assembly capable of adjusting an effective length of the leg members. The leg members include threaded wells for receiving removable and replaceable complementary threaded spike members.

10 Claims, 3 Drawing Sheets

ADJUSTABLE LEG FISHING CHAIR

BACKGROUND OF THE INVENTION

1. Field of the Invention

The present invention relates generally to chairs and, more particularly, to a chair especially adapted for fishing from the banks of bodies of water.

2. Description of the Prior Art

Chairs especially designed for seating a fisherman are well known in the art. The following U.S. patents are representative of some of these chairs: 3,623,766; 3,825,962; 4,103,965; 4,278,289; 4,772,068; and 4,722,567. U.S. Pat. Nos. 3,623,766, 3,825,962, 4,103,965, 4,278,289, and 4,722,567 have a common characteristic in that the respective front legs and the rear legs of the respective chairs are the same length.

Often, a fisherman fishes from the bank of a river or lake or other body of water. Most river banks, lake banks, and the like have a degree of slope or decline from the land to the water. Many people who fish stay at one location for a considerable period of time, and they prefer to sit down while fishing. When placing a conventional chair, having front and rear legs of equal height, on a bank, the person sitting often feels off balance or feels a considerable strain while sitting on the chair. In this respect, it would be desirable if a chair for fishermen were provided that permitted a fisherman to sit comfortably on the chair when the chair was placed on a river bank or the bank of another body of water. Further in this respect, it would be desirable if the fishermen's chair permitted the fisherman to sit level on a sloped bank of a body of water.

One of the patents cited above, namely U.S. Pat. No. 4,772,068, discloses a chair for fisherman that has adjustable rear legs that permit the seat of the chair to be adjusted to a level orientation by shorten some legs to accommodate a sloped surface. Although this patent addresses the problem of a sloped bank of a body of water, this patent does not address another important problem of a fisherman sitting on a bank. The other problem is the softness of sand or soil that is present. Often the sand or soil is not packed tightly. For this reason, the legs of the chair may readily wander as the person sits on the chair. In this respect, it would be desirable if a chair for fisherman were provided that included means for preventing the legs of the chair from wandering on sand or soil that is not tightly packed.

River banks and the like vary in their degrees of slope. In this respect, it would be desirable if a chair for fisherman were provided which were adjustable for a variety of sloped banks.

As mentioned above, it would be desirable if a fisherman's chair were especially adapted for sand or soil that is not tightly packed. Moreover, the fisherman may very well desire to use the same chair on other terrain, such as fiat terrain, or simply on a wooden floor or the like. In this respect, it would be desirable if a chair for fisherman were provided which were easily converted from a chair especially adapted for use on sand or soil to a chair adapted for use on a wooden floor or other fiat surface.

A chair that is used by fisherman may be carried considerable distances from an automobile or truck to a bank. In this respect, it would be desirable if a chair for fisherman were provided that were light weight and easily carried.

A chair that is used by fisherman is subjected to exposure to relatively large quantities of water and dirt. In this respect, it would be desirable if a chair for fisherman were provided that were resistant to rust and easily cleaned.

Some chairs to be used on boats by fisherman have swivelable seats. In this respect, it would be desirable if a chair for fisherman were provided that were especially adapted to be used on a bank of a body of water and also had a swivelable seat.

Thus, while the foregoing body of prior art indicates it to be well known to use chairs especially designed for use by fishermen, the prior art described above does not teach or suggest an adjustable leg fishing chair which has the following combination of desirable features: (1) permits a fisherman to sit comfortably on the chair when the chair is placed on a river bank or the bank of another body of water; (2) permits the fisherman to sit level on a sloped bank of a body of water; (3) includes means for preventing the legs of the chair from wandering on sand or soil that is not tightly packed; (4) is adjustable for a variety of sloped banks; (5) is easily converted from a chair especially adapted for use on sand or soil to a chair adapted for use on a wooden floor or other flat surface; (6) is light weight and easily carried; (7) is resistant to rust and easily cleaned; and (8) is especially adapted to be used on a bank of a body of water and also has a swivelable seat. The foregoing desired characteristics are provided by the unique adjustable leg fishing chair of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved adjustable leg chair apparatus which includes a seat assembly and a leg assembly supporting the seat assembly. The leg assembly includes a seat support member supporting the seat assembly and leg members supporting the seat support member. The leg assembly also includes spike members connected to the leg members. The spike members project from the leg members in a direction opposite of the seat support member. The spike members are capable of penetrating into a sloped ground surface. The leg members may include two vertical portions connected to the seat support member and a transverse member connected between the two vertical portions. The vertical portions and the transverse member are in the form of a unified, integrated U-shaped leg member. The spike members are supported by and project from the transverse members.

A swivel assembly is located between the seat assembly and the leg assembly. The swivel assembly supports the seat assembly and the swivel assembly is supported by the leg assembly. The swivel assembly includes a top bearing housing member connected to the seat assembly. A bottom bearing housing member is connected to the seat support member, and a bearing assembly is located between the top bearing housing member and the bottom bearing housing member, such that the top bearing housing member and the seat assembly are capable of swivelling on the bearing assembly as the bottom bearing housing member and the seat support member remain stationary.

Two of the leg members include a length adjusting assembly capable of adjusting an effective length of the leg members. The length adjusting assembly includes a first telescopic leg member connected to the seat support member. The first telescopic leg member includes a first locking element assembly. A second telescopic leg member is connected to the first telescopic leg member. The second telescopic leg member includes a second locking element assembly, wherein an adjusted length of the length adjusting assembly is obtained by adjusting the first telescopic leg member with respect to the second telescopic leg member, and the adjusted length of the length adjusting assembly is locked by engaging the first locking element with the second locking element.

The second telescopic leg member includes two vertical portions for connecting to respective first telescopic leg members, and a transverse member is connected between the two vertical portions. The two vertical portions and the transverse member of the second telescopic leg member are in the form of a unified, integrated structure.

The first locking element assembly includes a locking pin and a spring, located within the first telescopic leg member, for urging the locking pin outside a circumference of the first telescopic leg member, such that the locking pin is capable of engaging the second locking element assembly of the second telescopic leg member. The second locking element assembly includes an array of apertures located in a wall of the second telescopic leg member. The apertures are capable of receiving the locking pin of the first locking element assembly when the locking pin is placed in registration with an aperture.

One of the leg members includes means for receiving a removable and replaceable spike member, and the spike member includes attachment means for enabling removable and replaceable attachment of the spike member in the spike member receiving means of the leg member. More specifically, the spike member receiving means includes a threaded well, and the spike member attaching means includes a threaded end portion. The threaded end portion is capable of being is connected to or disconnected from the threaded well, whereby the spike member is capable of being removed from and replaced into the leg member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved adjustable leg fishing chair which has all of the advantages of the prior art and none of the disadvantages.

It is another object of the present invention to provide a new and improved adjustable leg fishing chair which may be easily and efficiently manufactured and marketed.

It is a further object of the present invention to pro, ride a new and improved adjustable leg fishing chair which is of durable and reliable construction.

An even further object of the present invention is to provide a new and improved adjustable leg fishing chair which is susceptible of a low cost of manufacture with regard to both materials and labor, and which accordingly is then susceptible of low prices of sale to the consuming public, thereby making such adjustable leg fishing chair available to the buying public.

Still yet a further object of the present invention is to provide a new and improved adjustable leg fishing chair which permits a fisherman to sit comfortably on the chair when the chair is placed on a river bank or the bank of another body of water.

Still another object of the present invention is to provide a new and improved adjustable leg fishing chair that permits the fisherman to sit level on a sloped bank of a body of water.

Yet another object of the present invention is to provide a new and improved adjustable leg fishing chair which includes means for preventing the legs of the chair from wandering on sand or soil that is not tightly packed.

Even another object of the present invention is to provide a new and improved adjustable leg fishing chair that is adjustable for a variety of sloped banks.

Still a further object of the present invention is to provide a new and improved adjustable leg fishing chair which is easily converted from a chair especially adapted for use on sand or soil to a chair adapted for use on a wooden floor or other flat surface.

Yet another object of the present invention is to provide a new and improved adjustable leg fishing chair that is light weight and easily carried.

Still another object of the present invention is to provide a new and improved adjustable leg fishing chair which is resistant to rust and easily cleaned.

Yet another object of the present invention is to provide a new and improved adjustable leg fishing chair that is especially adapted to be used on a bank of a body of water and also has a swivelable seat.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved adjustable leg fishing chair embodying the principles and concepts of the present invention will be described.

Figure 1:
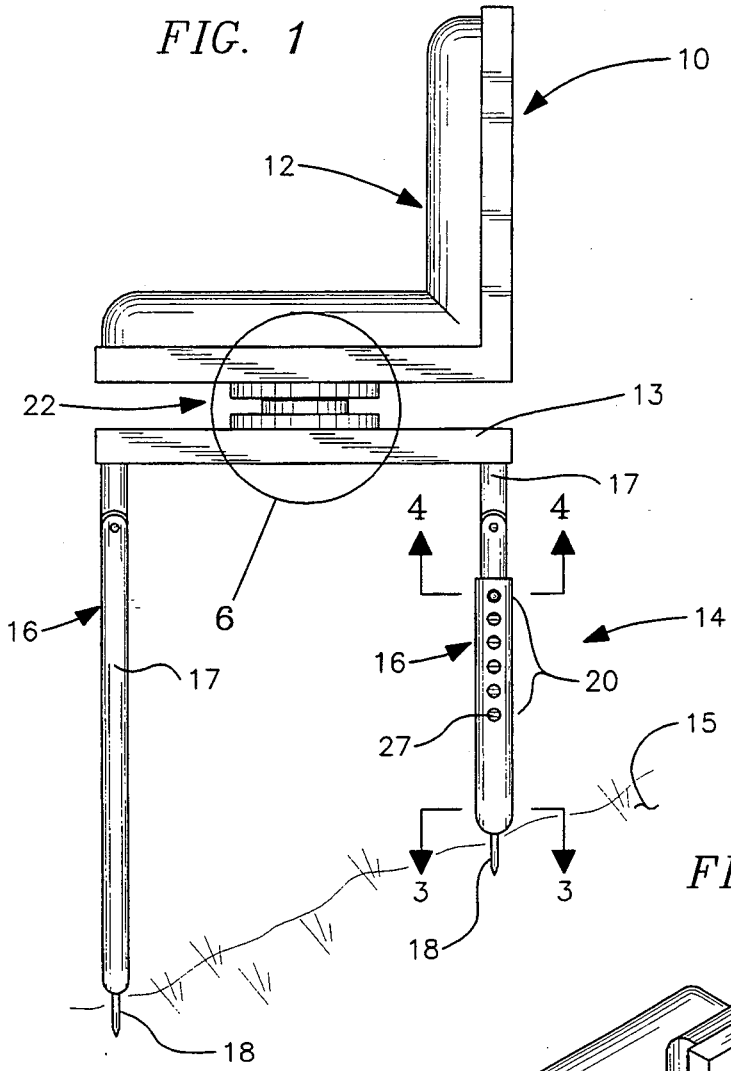
FIG. 1 is a side view showing a preferred embodiment of the adjustable leg fishing chair of the invention.
Figure 2:
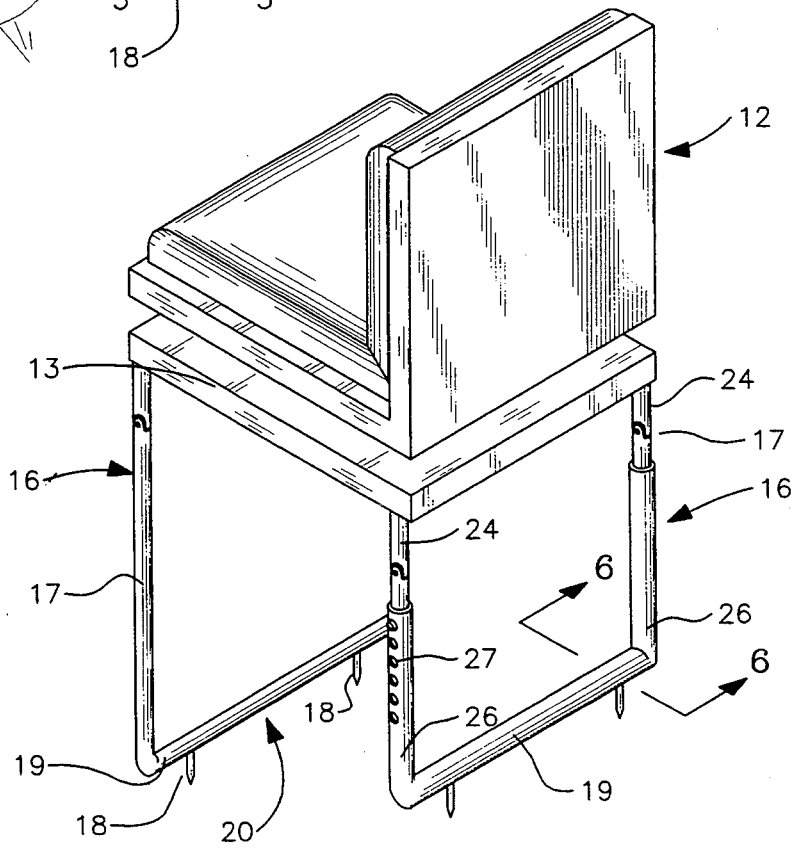
FIG. 2 is a rear perspective view of the embodiment of the invention shown in FIG. 1.

Turning initially to FIGS. 1 and 2, there is shown a preferred embodiment of the adjustable leg fishing chair of the invention generally designated by reference numeral 10. In its preferred form, adjustable leg fishing chair 10 includes a seat assembly 12 and a leg assembly 14 supporting the seat assembly 12. The leg assembly 14 includes a seat support member 13 supporting the seat assembly 12 and leg members 16 supporting the seat support member 13. The leg assembly 14 also includes spike members 18 connected to the leg members 16 The spike members 18 project from the leg members 16 in a direction opposite of the seat support member 13. The spike members 18 arc capable of penetrating into a sloped ground surface 15.

The leg members 16 include two vertical portions 17 connected to the seat support member 13 and a transverse member 19 connected between the two vertical portions 17. The vertical portions 17 and the transverse member 19 arc in the form of a unified, integrated U-shaped leg member 16. The spike members 18 are supported by and project from the transverse members 19.

Figure 6:
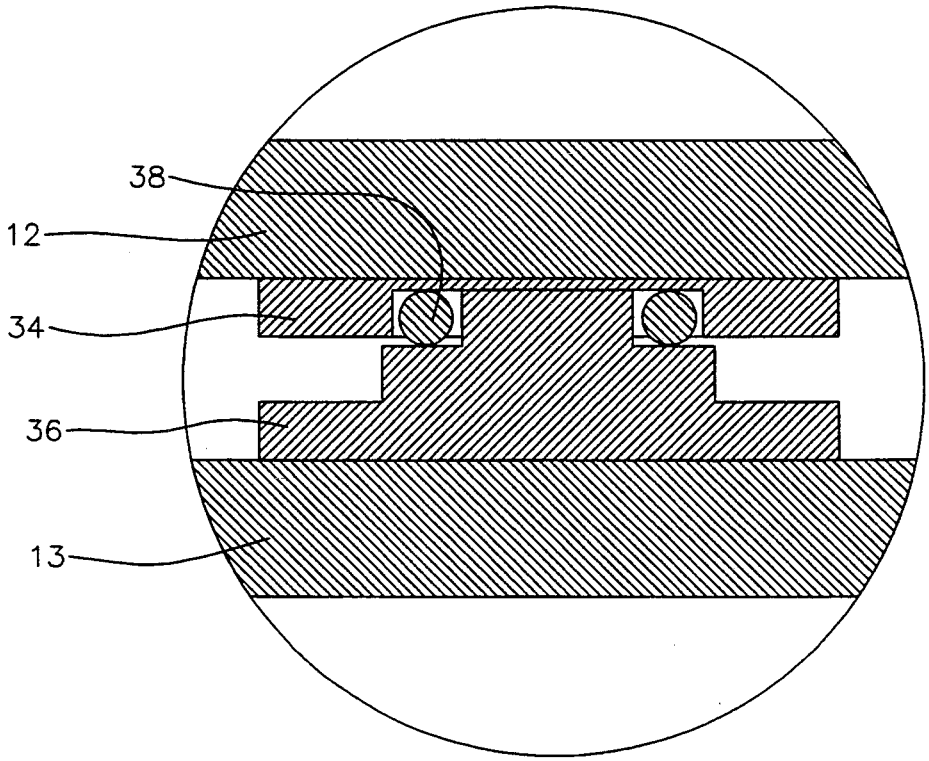
FIG. 6 is an enlarged cross-sectional view of the embodiment of the invention shown in FIG. 1 taken in the circled area 6 of FIG. 1.

As shown in FIG. 6, a swivel assembly 22 is located between the seat assembly 12 and the leg assembly 14. The swivel assembly 22 supports the seat assembly 12 and the swivel assembly 22 is supported by the leg assembly 14. The swivel assembly 22 includes a top bearing housing member 34 connected to the seat assembly 12. A bottom bearing housing member 36 is connected to the seat support member 13, and a bearing assembly 38 is located between the top bearing housing member 34 and the bottom bearing housing member 36, such that the top bearing housing member 34 and the seat assembly 12 are capable of swivelling on the bearing assembly 38 as the bottom bearing housing member 36 and the seat support member. 13 remain stationary.

Two of the leg members 16 include a length adjusting assembly 20 capable of adjusting an effective length of the leg members 16. The length adjusting assembly 20 includes a first telescopic leg member 24 connected to the seat support member 13. The first telescopic leg member 24 includes a first locking element assembly 25. A second telescopic leg member 26 is connected to the first telescopic leg member 24. The second telescopic leg member 26 includes a second locking element assembly 27, wherein an adjusted length of the length adjusting assembly 20 is obtained by adjusting the first telescopic leg member 24 with respect to the second telescopic leg member 26, and the adjusted length of the length adjusting assembly 20 is locked by engaging the first locking element 25 with the second locking element 27.

The second telescopic leg member 26 includes two vertical portions for connecting to respective first telescopic leg members 24, and a transverse member 19 is connected between the two vertical portions. The two vertical portions and the transverse member 19 of the second telescopic leg member 26 are in the form of a unified, integrated structure.

Figure 4:
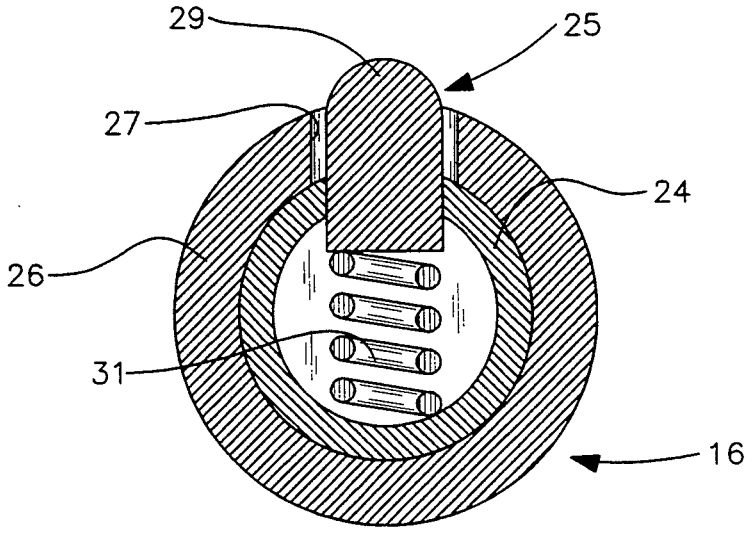
FIG. 4 is a cross-sectional view of the adjustable leg fishing chair of FIG. 1 taken along line 4—4 thereof.

As shown in FIG. 4, the first locking element assembly 25 includes a locking pin 29 and a spring 31, located within the first telescopic leg member 24, for urging the locking pin 29 outside a circumference of the first telescopic leg member 24, such that the locking pin 29 is capable of engaging the second locking element assembly 27 of the second telescopic leg member 26. The second locking element assembly 27 includes an array of apertures 27 located in a wall of the second telescopic leg member 26. The apertures 27 are capable of receiving the locking pin 29 of the first locking element assembly 25 when the locking pin 29 is placed in registration with an aperture 27.

In operation, to adjust the effective length of the leg members 16, the locking pin 29 is pressed in by a person's finger to overcome the tension of the spring 31. In this way, the locking pin 29 is cleared of the apertures 27 into which the locking pin 29 is capable of locking. When the desired length of the leg members 16 is obtained, the locking pin 29 is released, such that it locks into a selected aperture 27.

Figure 3:
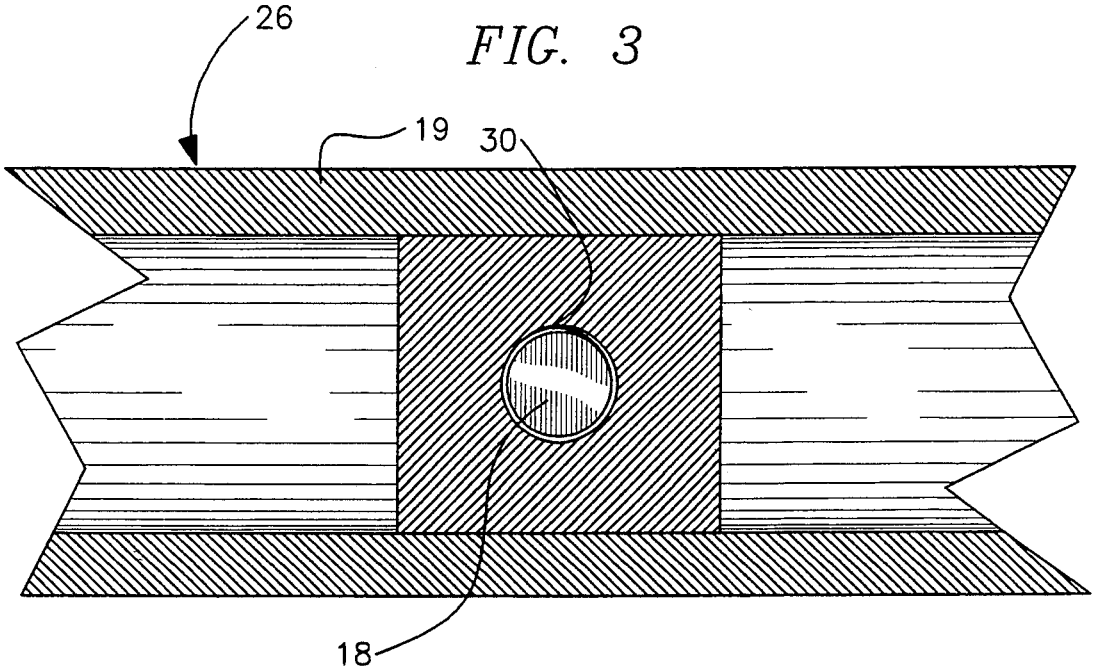
FIG. 3 is a cross-sectional view of the adjustable leg fishing chair of FIG. 1 taken along line 3—3 thereof.
Figure 5:
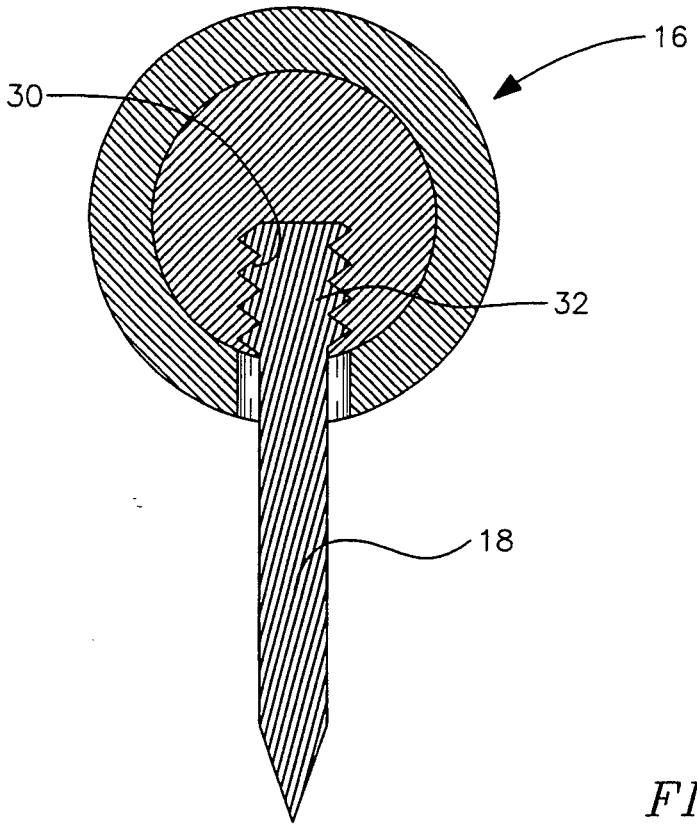
FIG. 5 is a cross-sectional view of the adjustable leg fishing chair of FIG. 2 taken along line 5—5 thereof.

As shown in FIGS. 3 and 5, one of the leg members 16 includes means for receiving a removable and replaceable spike member 18, and the spike member 18 includes attachment means for enabling removable and replaceable attachment of the spike member 18 in the spike member receiving means of the leg member 16. More specifically, the spike member receiving means includes a threaded well 30, and the spike member attaching means includes a threaded end portion 32. The threaded end portion 32 is capable of being is connected to or disconnected from the threaded well 30, whereby the spike member 18 is capable of being removed from and replaced into the leg member 16. In operation, the spike members 18 can be unscrewed from the leg members 16 if they are damaged and need to be replaced. In addition, if the chair is to be used on a flat surface, such as a wooden floor, the spike members 18 can easily be removed to convert the chair into one suitable for flat surfaces.

The components of the adjustable leg fishing chair of the invention can be made from inexpensive and durable metal and plastic materials. The metal is preferably made of aluminum or other rust-free metal. Both the metal and plastic materials should be readily washable for washing off dirt picked up when contacting the ground surface.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved adjustable leg fishing chair that is low in cost, relatively simple in design and operation, and which may advantageously be used to permit a fisherman to sit comfortably on the chair when the chair is placed on a river bank or the bank of another body of water. With the invention, an adjustable leg fishing chair is provided which permits the fisherman to sit level on a sloped bank of a body of water. With the invention, an adjustable leg fishing chair is provided which includes means for preventing the legs of the chair from wandering on sand or soil that is not tightly packed. With the invention, an adjustable leg fishing chair is provided which is adjustable for a variety of sloped banks. With the invention, an adjustable leg fishing chair is provided which is easily converted from a chair especially adapted for use on sand or soil to a chair adapted for use on a wooden floor. With the invention, an adjustable leg fishing chair is provided which is light weight and easily carried. With the invention, an adjustable leg fishing chair is provided which is resistant to rust and easily cleaned. With the invention, an adjustable leg fishing chair is provided which is especially adapted to be used on a bank of a body of water and also has a swivelable seat.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved adjustable leg chair apparatus, comprising:

a seat assembly, a leg assembly supporting said seat assembly, wherein said leg assembly includes a seat support member supporting said seat assembly, said leg assembly includes leg members supporting said seat support member, said leg assembly including spike members connected to said leg members, said spike members projecting from said leg members in a direction opposite of said seat support member, said spike members being capable of penetrating into a ground surface, and a swivel assembly located between said seat assembly and said leg assembly, said swivel assembly supporting said seat assembly and said swivel assembly being supported by said leg assembly, wherein said leg members include two vertical portions connected to said seat support member and a transverse member connected between said two vertical portions, wherein said spike members are supported by and project from said transverse members, and wherein only two of said leg members include a length adjusting assembly capable of adjusting an effective length of said leg members.

2. The apparatus described in claim 1 wherein said vertical portions and said transverse member are in the form of a unified, integrated U-shaped leg member.

3. The apparatus described in claim 1 wherein said swivel assembly includes:

a top bearing housing member connected to said seat assembly, a bottom bearing housing member connected to said seat support member, and a bearing assembly located between said top bearing housing member and said bottom bearing housing member, such that said top bearing housing member and said seat assembly are capable of swivelling on said bearing assembly as said bottom bearing housing member and said seat support member remain stationary.

4. The apparatus described in claim 1 wherein said length adjusting assembly includes:

a first telescopic leg member connected to said seat support member, said first telescopic leg member including a first locking element assembly, and a second telescopic leg member connected to said first telescopic leg member, said second telescopic leg member including a second locking element assembly, wherein an adjusted length of said length adjusting assembly is obtained by adjusting said first telescopic leg member with respect to said second telescopic leg member, and wherein said adjusted length of said length adjusting assembly is locked by engaging said first locking element with said second locking element.

5. The apparatus described in claim 4 wherein said second telescopic leg member includes:

two vertical portions for connecting to respective first telescopic leg members, and a transverse member connected between said two vertical portions.

6. The apparatus described in claim 5 wherein said two vertical portions and said transverse member of said second telescopic leg member are in the form of a unified, integrated structure.

7. The apparatus described in claim 4 wherein said first locking element assembly includes:

a locking pin, and a spring, located within said first telescopic leg member, for urging said locking pin outside a circumference of said first telescopic leg member, such that said locking pin is capable of engaging said second locking element assembly of said second telescopic leg member.

8. The apparatus described in claim 4 wherein said second locking element assembly includes an array of apertures located in a wall of said second telescopic leg member, said apertures capable of receiving said locking pin of said first locking element assembly.

9. The apparatus described in claim 1 wherein:

one of said transverse members includes means for receiving a removable and replaceable spike member, and said spike member includes attachment means for enabling removable and replaceable attachment of said spike member in said spike member receiving means of said transverse member.

10. The apparatus described in claim 9 wherein:

said spike member receiving means include a threaded well, and said spike member attaching means include a threaded end portion, wherein said threaded end portion is capable of being connected to or disconnected from said threaded well, whereby said spike member is capable of being removed from and replaced into said transverse member.

* * * * *